US006857367B2

(12) United States Patent
Heller et al.

(10) Patent No.: US 6,857,367 B2
(45) Date of Patent: Feb. 22, 2005

(54) EQUIPMENT FOR COATING PRINTING MATERIALS IN A PRINTING PRESS, AND METHOD OF OPERATING THE EQUIPMENT

(75) Inventors: Bernd Heller, Neckargemünd (DE); Daniel Prieto-Dörfel, München (DE); Rainer Hofmann, Leimen (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 1 day.

(21) Appl. No.: 10/290,366

(22) Filed: Nov. 7, 2002

(65) Prior Publication Data

US 2003/0084805 A1 May 8, 2003

(30) Foreign Application Priority Data

Nov. 7, 2001 (DE) ..... 101 54 513

(51) Int. Cl.[7] ..... B41M 00/00
(52) U.S. Cl. ..... 101/483; 101/424
(58) Field of Search ..... 101/483, 423–425, 101/365, 366; 15/256.51, 256, 256.52; 134/18; 118/46, 50, 602

(56) References Cited

U.S. PATENT DOCUMENTS

| | | | | |
|---|---|---|---|---|
| 2,545,445 A | | 3/1951 | Chatterton | |
| 3,947,356 A | * | 3/1976 | Werhli | 210/96.1 |
| 4,369,734 A | * | 1/1983 | Preuss | 118/702 |
| 5,003,352 A | * | 3/1991 | Duchesne et al. | 399/238 |
| 5,367,982 A | * | 11/1994 | DeMoore et al. | 118/46 |
| 5,683,508 A | * | 11/1997 | Bleiler et al. | 118/46 |
| 5,797,328 A | * | 8/1998 | Lippold et al. | 101/483 |
| 5,839,456 A | * | 11/1998 | Han | 134/104.1 |
| 5,878,663 A | * | 3/1999 | Krzyzak et al. | 101/148 |
| 5,967,044 A | * | 10/1999 | Marschke | 101/363 |
| 6,318,259 B1 | * | 11/2001 | Chou et al. | 101/350.5 |

FOREIGN PATENT DOCUMENTS

| | | |
|---|---|---|
| DE | 41 16 989 A1 | 11/1992 |
| DE | 296 16 686 U1 | 1/1997 |
| DE | 297 22 601 U1 | 3/1998 |
| DE | 196 43 984 A1 | 5/1998 |
| DE | 197 57 094 A1 | 6/1999 |
| DE | 199 02 567 A1 | 8/2000 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A method of operating equipment for coating printing materials in a printing press includes providing equipment made up of at least one metering system and a circulating line system associated with the metering system for at least one liquid medium received in at least one container. The circulating line system also has a pump subsystem with at least one feed pump for feeding the liquid medium from the container to the metering system, and at least one return pump for returning the liquid medium from the metering system into the container. Furthermore, a feed line is disposed between the metering system and the feed pump. In order to preferably completely empty at least the feed line, the steps of shutting off a medium connection between the feed pump and the container and connecting a suction side of the feed pump to a space having a gaseous medium, for sucking in the gaseous medium by the feed pump and, as viewed in pumping direction of the feed pump, for pumping the gaseous medium into the feed line, are carried out. Equipment to be operated according the method is also provided.

29 Claims, 4 Drawing Sheets

EQUIPMENT FOR COATING PRINTING MATERIALS IN A PRINTING PRESS, AND METHOD OF OPERATING THE EQUIPMENT

BACKGROUND OF THE INVENTION

Field of the Invention

The invention relates to a method of operating equipment for coating printing materials in a printing press. The invention also relates to equipment for coating printing materials in a printing press.

German Published, Non-prosecuted Patent Application DE 197 57 094 A1, corresponding to British Patent 2 232 394, discloses equipment for coating printing materials in a printing press, which has a metering system that, with the aid of a circulating-pipeline system, can be supplied with a liquid coating medium, for example varnish, in a container. The circulating-pipeline system includes a feed pump for feeding the coating medium to the metering system and two suction pumps, by which the coating medium is conducted back from the metering system into the container. In order to clean a feed line disposed downstream of the feed pump and leading to the metering system, the metering system itself and return lines leading from the metering system to the container, the lines must first be emptied. In order to empty the feed line, an additional, i.e., a third, suction pump is provided, which serves only for emptying the feed line, the suction side of the third suction pump being connected to the feed line via a bypass and the pressure side of the third suction pump being connected to the container via a fluid connection. Because of the many pumps, the costs and the space required for this equipment are correspondingly high. In a second alternative embodiment, the extraction of the feed line is performed only by the feed pump, which is of convertible construction for interchanging the suction and pressure region thereof, so that the feed line is connected as desired either to the pressure side or the suction side of the feed pump.

U.S. Pat. No. 2,545,445 discloses equipment having a metering system to which a circulating-line system is assigned which includes a feed pump and a return pump, which are mutually coupled and driven by a motor. In order to divide the fluid stream leading to the metering system via a feed line, a fluid connection disposed between the feed line and the suction region of the return pump is provided, which can be shut off by a valve device. A disadvantage of this equipment is that automatic or automated emptying of the feed line is not possible therewith.

SUMMARY OF THE INVENTION

It is accordingly an object of the invention to provide equipment for coating printing materials in a printing press and a method of operating the equipment, which overcome the hereinafore-mentioned disadvantages of the heretofore-known devices and methods of this general type and which achieve automatic emptying of at least a feed line.

With the foregoing and other objects in view, there is provided, in accordance with the invention, a method of operating equipment for coating printing materials in a printing press. The method comprises providing equipment including at least one metering system and a circulating line system associated with the metering system for at least one liquid medium received in at least one container. The circulating line system has a pump subsystem including at least a feed pump for feeding the liquid medium from the container to the metering system, and at least a return pump for returning the liquid medium from the metering system into the container. A feed line is disposed between the metering system and the feed pump. The method also comprises, for the purpose of preferably completely emptying at least the feed line, the steps of shutting off a medium connection between the feed pump and the container, and connecting a suction side of the feed pump to a space having a gaseous medium, for sucking in the gaseous medium by the feed pump and, as viewed in pumping direction of the feed pump, for pumping the gaseous medium into the feed line.

In accordance with another mode, the method of the invention includes, during the emptying of at least the feed line, sucking in the liquid medium by the return pump in a bypass disposed between the feed line and a suction side of the return pump and in the feed line, and conducting the liquid medium back into the container.

In accordance with a further mode, the method of the invention further includes pumping the gaseous medium, which is sucked in by the feed pump, directly into the feed line.

In accordance with an added mode, the method of the invention further includes pumping the gaseous medium, which is sucked in by the feed pump, into the feed line via a medium connection disposed between a pressure side of the feed pump and the feed line.

In accordance with an additional mode, the method of the invention further includes, during the emptying of at least the feed line, sucking in ambient air by the return pump via the bypass and the feed line.

In accordance with yet another mode, the method of the invention further includes, during the emptying of at least the feed line, emptying the metering system via a medium connection disposed between the metering system and a suction side of the return pump, which is in operation.

In accordance with yet a further mode, the method of the invention further includes, during the emptying of at least the feed line, operating both the feed pump and the return pump.

In accordance with yet an added mode, the method of the invention further includes providing that a delivery direction of at least one of the feed pump and the return pump is the same both during feeding of one of a liquid coating medium and a cleaning fluid to the metering system, and during the emptying of at least the feed line.

In accordance with yet an additional mode, the method of the invention further includes, at the start of the emptying of at least the feed line, shutting off the bypass completely, and initially feeding to the feed line the gaseous medium sucked in by the feed pump, while simultaneously emptying the metering system by the return pump.

In accordance with still another mode, the method of the invention further includes, in a next step, shutting off the medium connection between a pressure side of the feed pump and the feed line, and opening the bypass, for pumping into the container by the return pump the liquid medium remaining in the feed line.

In accordance with still a further mode, the method of the invention further includes continuing the operation of the feed pump even when the medium connection between the pressure side thereof and the feed line is blocked.

In accordance with still an added mode, the method of the invention further includes maintaining the bypass always at least partly open during one of feeding of one of a liquid coating medium and a cleaning fluid to the metering system and emptying the feed line.

In accordance with still an additional mode, the method of the invention further includes adjusting the quantity of medium returned past the metering system via the bypass and into the container.

With the objects of the invention in view, there is also provided equipment for coating printing materials in a printing press. The equipment comprises at least one metering system. A circulating line system is associated with the metering system for at least one liquid medium received in at least one container. The circulating line system includes a pump subsystem having at least one feed pump for feeding the liquid medium from the container to the metering system, and at least one return pump for returning the liquid medium from the metering system into the container. A feed line is disposed between the metering system and the feed pump. A valve configuration influences flow of the liquid medium in the circulating line system. The valve configuration, in a first functional position thereof, shuts off a medium connection between a suction side of the feed pump and the container, and connects the suction side of the feed pump to a space having at least one gaseous medium therein.

In accordance with another feature of the invention, the equipment further includes a bypass disposed between the feed line and a suction side of the return pump, and a first valve device for at least partly shutting off and opening the bypass.

In accordance with a further feature of the invention, the feed line is directly connected to the feed pump.

In accordance with an added feature of the invention, the equipment further includes a medium connection disposed between the feed pump and the feed line, the medium connection being capable of being at least partly shut off.

In accordance with an additional feature of the invention, the equipment further includes a first valve device for at least partly shutting off the medium connection disposed between the feed pump and the feed line.

In accordance with yet another feature of the invention, in a second functional position of the valve configuration, the bypass and the medium connection between the suction side of the feed pump and the container are shut off, and the suction side of the feed pump is connected to the space having the gaseous medium therein.

In accordance with yet a further feature of the invention, in a third functional position of the valve configuration, the medium connection between the suction side of the feed pump and the container, and a medium connection between the feed pump and the feed line are shut off, the suction side of the feed pump being connected to the space having the gaseous medium therein, and the bypass being opened.

In accordance with yet an added feature of the invention, in a fourth functional position of the valve configuration, the medium connection between the suction side of the feed pump and the container is opened, and the bypass and a connection between the suction side of the feed pump and the space having the gaseous medium therein are shut off.

In accordance with yet an additional feature of the invention, the valve configuration has a plurality of valve devices, of which at least one is formed by a ball valve.

In accordance with still another feature of the invention, the ball valve is a three-way ball valve.

In accordance with still a further feature of the invention, the feed pump and the return pump are actuatable simultaneously.

In accordance with still an added feature of the invention, at least one pump of the feed pump and the return pump is suitable for pumping both liquid and gaseous media.

In accordance with still an additional feature of the invention, the equipment further includes only one drive device for actuating the feed pump and the return pump.

In accordance with another feature of the invention, the only one drive device has only one motor.

In accordance with a further feature of the invention, at least one pump of the feed pump and the return pump is formed of a pump selected from the group consisting of displacement and peristaltic pumps.

In accordance with an added feature of the invention, the pump subsystem is formed by a double diaphragm pump.

In accordance with an additional feature of the invention, the valve configuration has a plurality of valve devices, and the equipment further includes a control unit for actuating at least one of the valve devices, the feed pump and the return pump.

In accordance with a concomitant mode of the method and feature of the equipment, ambient air is provided as the gaseous medium.

In order to achieve the object of the invention, a method of operating equipment for coating printing materials in a printing press is thus proposed wherein the equipment includes a circulating line system for at least one liquid medium which is received in at least one container and which is assigned to a metering system for a liquid coating medium. The circulating line system includes a pump subsystem having at least one feed pump for feeding the liquid medium from the container into the metering system, and at least one return pump for returning the liquid medium from the metering system into the container. A feed line is disposed between the metering system and the feed pump. In order to empty at least the feed line, which is necessary for example for cleaning the metering system or the circulating line system or can be required in the event of a change in the coating medium, at least a medium connection between the container and the feed pump is shut off so that the feed pump cannot take in any new medium from the container and otherwise supply it to the lines of the circulating line system. Furthermore, the suction side of the feed pump is connected to a space wherein a gaseous medium is received, so that the gaseous medium is taken in by the feed pump and, as viewed in the direction of delivery of the feed pump, is pumped into the feed line. The feed pump is therefore operating during the emptying of at least the feed line, and pumps the intake of gaseous medium, preferably ambient air, into the feed line, as a result of which the liquid medium therein is displaced and, for example, escapes from the feed line via the open end thereof associated with the metering system. It becomes clear that, in order to empty the feed line, it is not necessary to interchange the suction side and the pressure side of the feed pump instead, the feed pump always delivers in the same direction both during the emptying of at least the feed line and during the supplying of the metering system with a liquid medium. It is therefore not necessary to use a reversible feed pump, which is relatively expensive, or an additional pump. A more cost-effective construction of the equipment is therefore realizable.

In a preferred embodiment, provision is made for the gaseous medium sucked in by the feed pump to be ambient air, i.e., the space connected to the suction side of the feed pump is not a container or the like but the surroundings wherein the equipment is located.

Particular preference is given to a mode of the method which provides that, during the emptying operation, the medium in a bypass disposed between the feed line and the suction side of the return pump, and in the teed line is sucked in by the return pump and conducted back into the container. In order to empty the feed line, therefore, the return pump which is present in any case serves for sucking in the liquid medium in the feed line and pumping it back into the container. In this regard, ambient air is sucked in after it via the open end of the feed line opening into the metering system, and when the feed line is empty and the bypass is empty, the ambient air extends as far as the return pump. In a preferred embodiment, provision is made, by the return pump, for both liquid and gaseous media to be deliverable. It is therefore possible for the return pump to pump the ambient air sucked in via the bypass and the feed line into the medium connection disposed between the return pump and the container, as a result of which the liquid medium located therein is forced back into the container, so that this medium connection is likewise emptied completely.

Furthermore, a mode of the method is preferred which is distinguished by the fact that, during the emptying operation, the metering system is emptied via a medium connection disposed between the metering system and the suction side of the return pump which is in operation. Via this medium connection, therefore, the liquid medium in the metering system, which may be a coating medium, for example varnish, or a cleaning fluid, is preferably extracted completely. In this regard, provision is made, when the metering system is emptied via this medium connection, for ambient air to be sucked in, so that the medium connection disposed between the metering system and the return pump can also be emptied completely.

Particular preference is given to a mode of the method wherein, during the emptying of at least the feed line, both the feed pump and the return pump are operating, a gaseous medium, for example ambient air being sucked in by the feed pump, and also ambient air being sucked in by the return pump when the metering system is emptied, and introduced into the circulating line system for the purpose of emptying the latter. Due to this measure, it is readily possible to couple the feed pump and the return pump to one another in a manner that they can be operated only together. In order to operate these pumps, only one drive, i.e., a motor, would be required.

Preference is also given to a mode of the method which provides for the direction of delivery of the feed pump and/or that of the return pump to be the same both during the feeding of a liquid coating medium or a cleaning fluid to the metering system and during an emptying operation. It is therefore possible to dispense with the use of reversible pumps, the pressure and suction sides of which are interchangeable, so that a more cost-effective construction of the equipment is realizable.

In an advantageous mode of the method, at the start of the emptying operation, the bypass, i.e., the connection of the feed line to the suction side of the return pump, is shut off completely, so that the gaseous medium sucked in by the feed pump is initially fed only to the feed line and does not pass to the return pump via the bypass. At the same time, the metering system is emptied by the return pump. At the start of the emptying operation, therefore, first of all the medium connection between the feed pump and the space having the gaseous medium therein is emptied. As soon as the gaseous medium passes into the feed line, it displaces the liquid medium there, which passes into the metering system via the open end of the feed line. In a preferred embodiment, provision is made, in a next step, for a medium connection disposed between the pressure side of the feed pump and the feed line to be shut off and the bypass opened, which leads to the liquid medium remaining in the feed line to be pumped back into the container via the bypass by the return pump.

Furthermore, a mode of the method is preferred which is distinguished by the fact that the feed pump continues to operate even when the medium connection disposed between the pressure side and the feed line thereof is blocked. During this phase of the emptying operation, therefore, the gaseous medium sucked in by the feed pump is no longer pumped into the feed line but compressed in this medium connection, the gaseous medium preferably being blown off when a specific pressure in this line section is exceeded.

The equipment of the invention is distinguished by the fact that, in a first functional position of a valve configuration, a medium connection between the suction side of the feed pump and the container is shut off and the suction side of the feed pump is connected to a space having at least a gaseous medium, preferably ambient air. This makes it possible for both pumps, i.e., both the feed and the return pump, to be in operation during the emptying operation, the feed pump sucking in no new fluid medium from the container, but rather, a gaseous medium which, at least in the initial phase of the emptying operation, is pumped into the feed line. It is particularly advantageous that, by the equipment according to the invention, automatic emptying at least of the feed line and, if appropriate, of the entire circulating line system and of the metering system is realizable, preferably only the feed pump and the return pump being required for this purpose, and can be in operation simultaneously during the emptying operation, so that the two pumps can be coupled with one another and driven by only one drive or motor. In order to empty at least the feed line, the feed pump and the return pump do not have to be of reversible construction, because a change in the delivery direction of these pumps for the purpose of emptying the feed line or the entire circulating line system and the metering system is not required. The equipment is distinguished by a simple construction and, when compared with heretoforeknown equipment, can have a reduced number of individual components.

Advantageous exemplary embodiments of the equipment emerge from combinations of various features thereof.

Other features which are considered as characteristic for the invention are set forth in the appended claims.

Although the invention is illustrated and described herein as embodied in equipment for coating printing materials in a printing press and a method of operating the equipment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
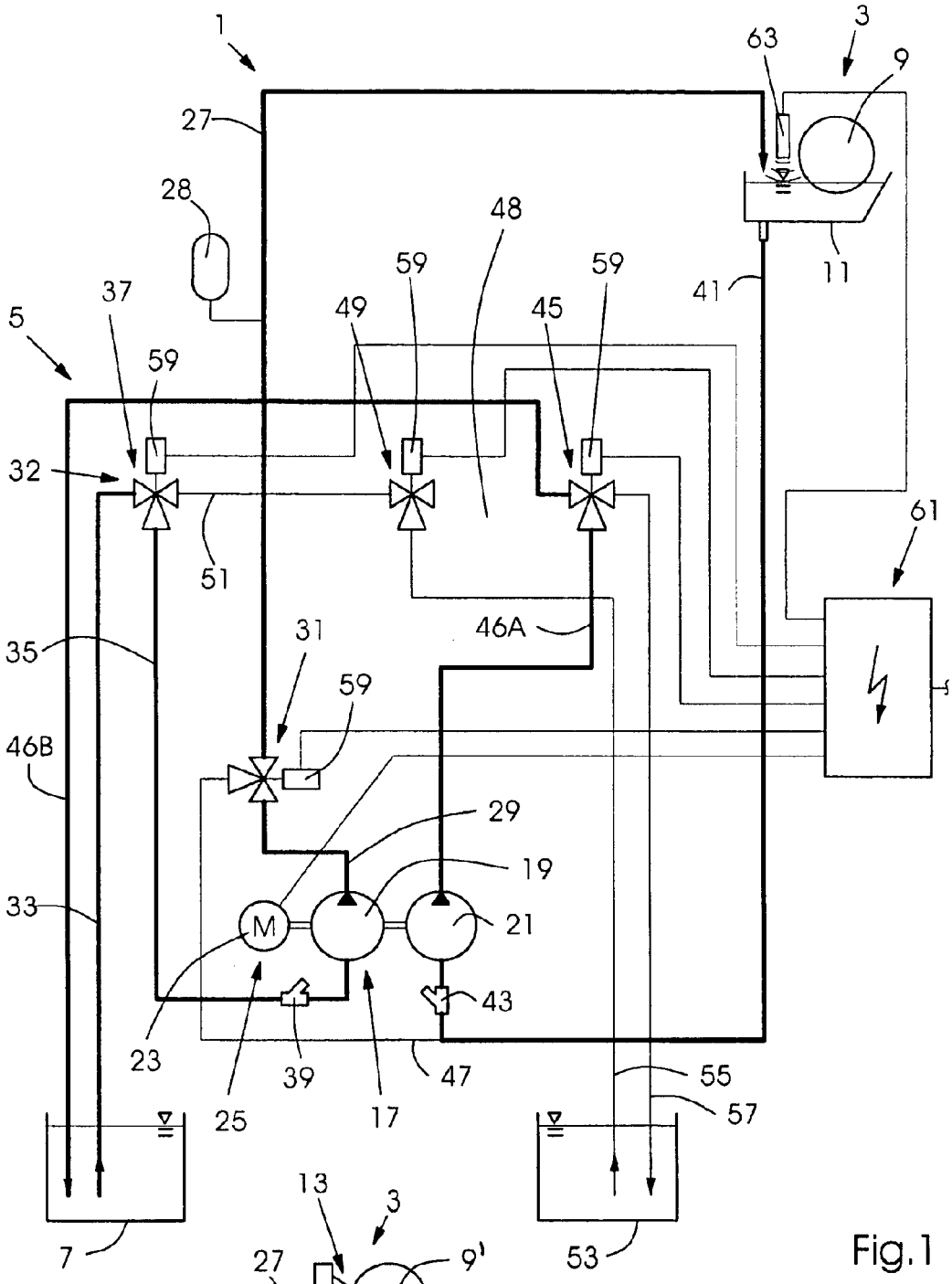
FIG. 1 is a basic schematic and block diagram of an exemplary embodiment of equipment including a metering system and a circulating line system, the circulating line system being in a first operating state.

Referring now to the figures of the drawings in detail and first, particularly, to FIG. 1 thereof, there is seen equipment 1 according to the invention, which serves for coating printing materials in a printing press, that is not otherwise specifically illustrated. The printing materials can be, for example, sheets of paper or board, such as cardboard or pasteboard, or a continuous web or, for example, panels formed of sheet metal. The equipment 1 includes a metering system 3 for a liquid coating medium to be applied to the printing materials, such as varnish, for example. Operatively associated with the metering system 3 is a circulating line system 5, illustrated schematically herein, for the at least one liquid coating medium which is provided in a container 7.

Figure 3:
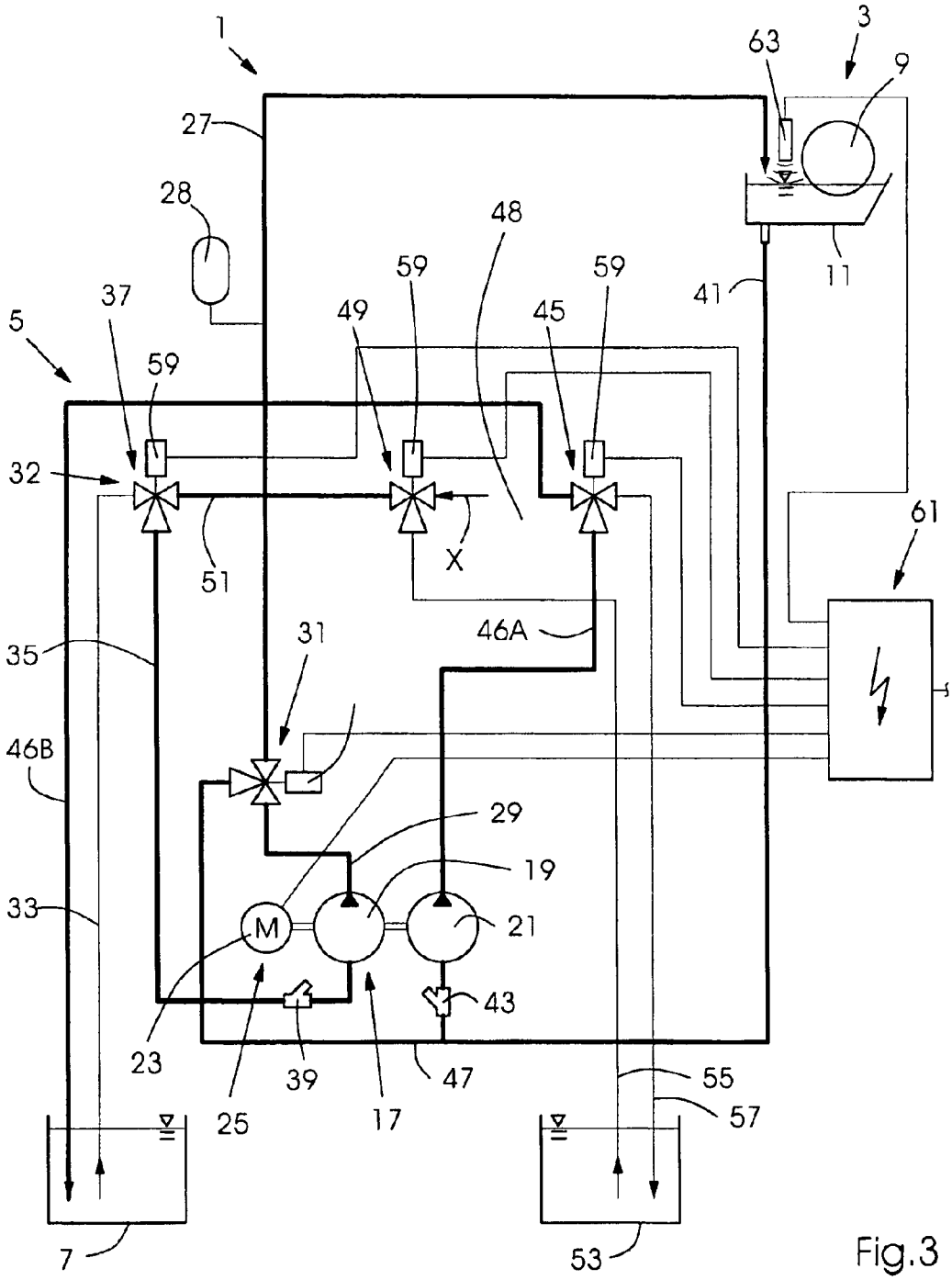
FIG. 3 is a view similar to FIG. 1, showing the equipment according to the invention with the circulating line system in a second operating state.
Figure 4:
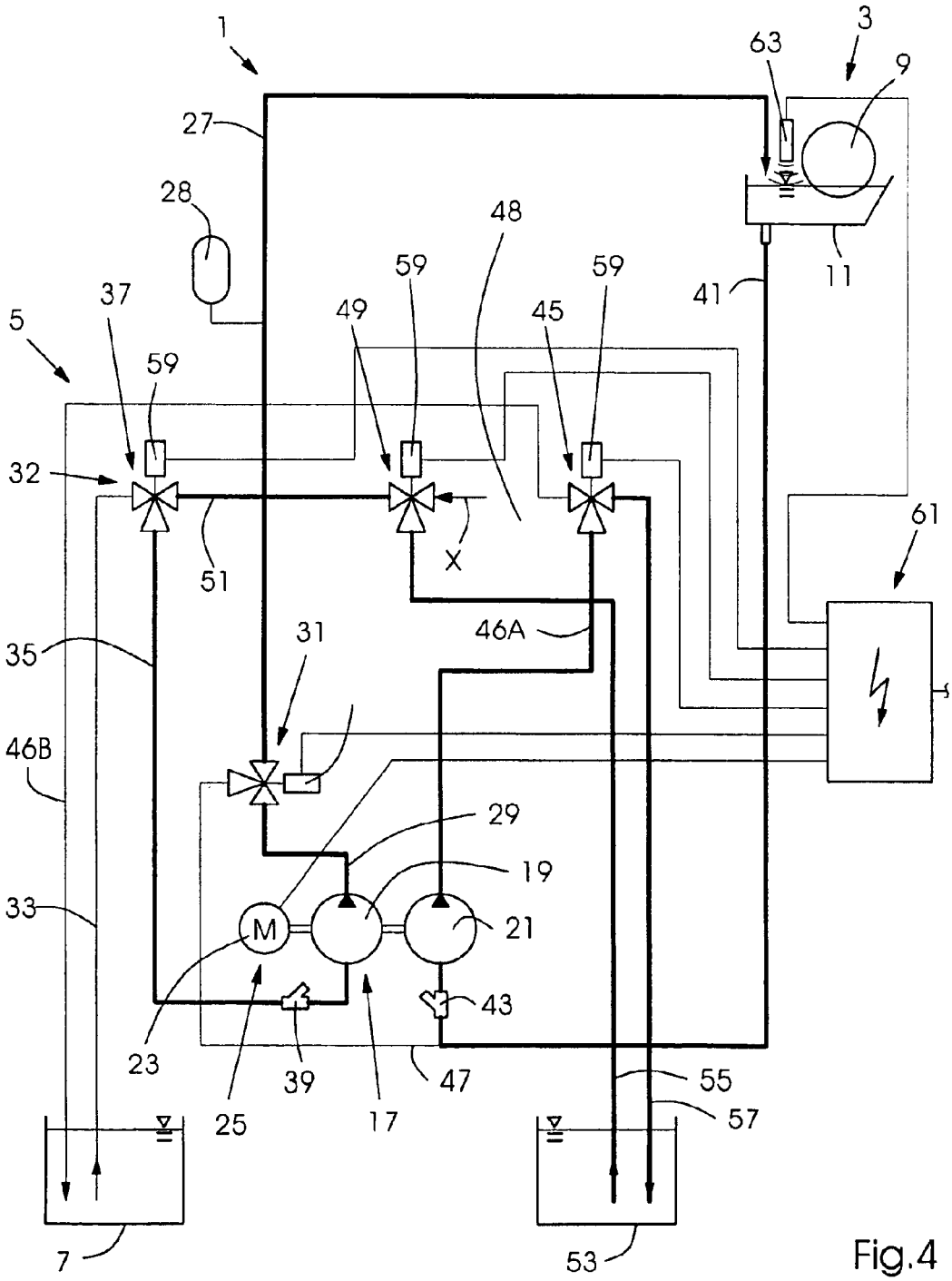
FIG. 4 is another view similar to FIGS. 1 and 3, showing the equipment according to the invention with the circulating line system in a third operating state.

The metering system 3 illustrated in FIG. 1, as well as in FIGS. 3 and 4, is constructed as a roller system, which includes a roller 9 and a trough 11 that holds the liquid coating medium and can be filled and emptied by the circulating line system 5. The liquid coating medium, for example varnish, is scooped up from the trough 11 by the roller 9 and metered onto a second, non-illustrated roller by squeezing. More than two rollers could also be required depending upon the configuration and direction of rotation of the rollers.

Figure 2:
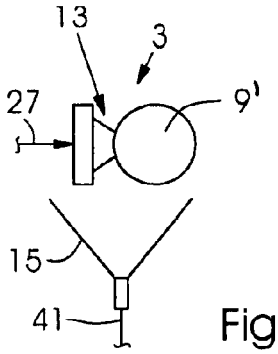
FIG. 2 is a basic fragmentary, elevational view of FIG. 1 showing a second exemplary embodiment of the metering system.

FIG. 2 shows a second exemplary embodiment of the metering system 3, which is constructed as a chambered doctor blade system, wherein the coating medium is applied to a roller 9', in particular an engraved roller, and metered with the aid of a chambered doctor blade 13. Excess coating medium is collected in a collecting trough 15 disposed underneath the metering system 3 and guided back into the circulating line system 5.

The construction of a metering system 3 used in connection with the equipment 1 can, in principle, also differ from the metering systems described herein-above. It is possible for the circulating line system 5 described hereinbelow to be virtually the same for all different embodiments or modifications of the metering system 3.

The circulating line system 5 includes a pump system or assembly 17 including a feed pump 19 and a return pump 21, which are coupled with one another and can be operated by a drive device 25 having only one motor 23. The pumps 19 and 21 are thus mutually coupled so that they can be started up and switched off together only. The feed pump 19 and the return pump 21 are constructed here so that they are able to pump only in one direction, i.e., the pressure region and the suction region of the respective pump cannot be interchanged. The feed pump 19 and the return pump 21 can, for example, be formed by a double diaphragm pump. It is also possible for displacement pumps or peristaltic pumps, including reversible peristaltic pumps, to be used besides diaphragm pumps.

The circulating line system 5 includes a feed line 27 for supplying the trough 11 of the metering system 3 with the liquid coating medium. Connected to the feed line 27 is a pulsation damper 28 which, when a diaphragm pump, for example, is used as the feed pump, damps the pulsations which occur. Between the pressure region of the feed pump 19 and the feed line 27, there is a medium connection which is formed in this case by a flow line 29 and can be shut off and opened by a first valve device 31. The first valve device 31 is part of a valve configuration 32 for influencing the flow of medium in the circulating line system 5. The valve configuration 32 has a plurality of valve devices, which are discussed hereinbelow in greater detail. A further medium connection is provided between the suction side of the feed pump 19 and the container 7 holding the liquid coating medium. This further medium connection is formed by forward flow lines 33 and 35. A connection between the forward flow lines 33 and 35 is effected via a second valve device 37, through which this medium connection can be shut off and opened. A filter 39 is provided in the flow line 35.

A return line 41 which is coupled with the trough 11 is connected to the suction side of the return pump 21 and is provided with a filter 43 connected therein. A medium connection disposed between the pressure side of the return pump 21 and the container 7 is formed by return lines 46A and 46B which are connected to one another by a third valve device 45. This medium connection can be shut off and opened with the aid of the third valve device 45.

In FIG. 1, a thick line serves for emphasizing the medium connections or lines of the circulating line system 5 which are active during the feeding of the coating medium from the container 7 to the metering system 3 and in returning excess coating medium from the metering system 3 into the container 7. In this state of the circulating line system 5, therefore, both pumps 19 and 21 are in operation, and the valve devices 31, 37 and 45 are switched over in such a manner that the feed pump 19 sucks in the coating medium from the container 7 and pumps it to the metering system 3 via the feed line 27. At the same time, through the intermediary of the return pump 21, coating medium in the trough 11 is sucked in via the return line 41 and fed back into the container 7.

For the purpose of preferably completely emptying at least the feed line 27, the circulating line system 5 is provided with a bypass 47, by which a medium connection can be produced between the feed line 27 and the suction side of the return pump 21. Because the bypass 47 is not used when the metering system 3 is being supplied with the coating medium, the bypass 47 can preferably be shut off completely and can be opened as required, the performance of which, in an exemplary embodiment of the circulating line system 5 illustrated in FIGS. 1 to 4, is advantageously carried out by the first valve device 31.

Hereinafter, with respect to FIG. 3, a more detailed explanation will be given as to how at least the feed line 27 and the metering system 3 can be emptied automatically, for example for cleaning purposes. In FIG. 3, a thick line serves for emphasizing the medium connections and lines of the circulating line system 5 which are active during the emptying of the circulating line system 5 and of the metering, system 3, i.e., have a liquid or gaseous medium applied thereto, not all of the lines being active at every time during the emptying operation, as is described in greater detail hereinbelow. During the emptying operation, the feed and the return pumps 19 and 21, respectively, are in operation. Starting from the functional position of the valve configuration 32 and the valve devices 31, 37, 45 and 49 thereof, as described with reference to FIG. 1, the second valve device 37 is initially switched over in a manner that the medium connection between the flow lines 33 and 35 is interrupted, so that the feed pump 19 can no longer suck in any further coating medium from the container 7. Furthermore, a medium connection is produced between the suction side of the feed pump 19 and a space 48 having a gaseous medium therein. The space 48 is formed in this case by the surroundings, i.e., the gaseous medium is ambient air. The medium connection between the feed pump 19 and the space 48 is formed in this case by the flow line 35 and a connecting line 51 coupled at one end thereof with the second valve device 37 and at the other end thereof with a fourth valve device 49. In this functional position of the valve configuration 37, the feed pump 19 sucks in ambient air, as indicated by an arrow X. As a result, initially, the coating medium still in the flow line 35 is pumped into the feed line 27, so that the flow line 35 is therefore emptied.

The coating medium in the flow line 33 preferably flows automatically back into the container 7, so that this line 33 is also emptied. During this time, the return pump 21 extracts the coating medium in the metering system 3 via the return line 41 and pumps it back into the container 7 through the return lines 46A and 46B.

After the coating medium in the forward flow line 35 and possibly in the forward flow line 29 has preferably been pumped completely into the feed line 27, so that there is at least approximately only ambient air in the aforementioned lines 35 and 29, the bypass 47 is opened by the first valve device 31 in a next step. In this regard, the medium connection between the forward flow line 29 and the feed line 27 is also simultaneously shut off, while the pumps 19 and 21 continue to operate. Because there is at least approximately only ambient air in the forward flow lines 35 and 29, the ambient air is at best compressed in the forward flow line 29, so that damage to the circulating line system 5 can be ruled out, which would not be the case if there were a liquid in the forward flow lines 35 and 29. In this functional position of the valve configuration 32, the coating medium in the feed line 27 is extracted by the return pump 21 via the bypass 47 and guided back into the container 7. Due to the extraction of the coating medium from the feed line 27 by the return pump 21, ambient air then flows in and is sucked in or aspirated, respectively, via the open end of the feed line 27 in the vicinity of the metering system 3, so that the feed line 27 and the bypass 47 can be emptied completely. As soon as the feed line 27, the bypass 47 and the return line 41 have been emptied completely, the sucked-in or aspirated air is forced into the return lines 46A and 46B by the return pump 21, due to which the liquid coating medium therein is displaced into the container 7.

It thus becomes clear that, by the method described hereinabove for at least partially emptying the circulating line system 5, at least the feed line 27, the metering system 3, in particular the trough 11, and preferably at least approximately all of the return line 41 can be emptied. Assuming an appropriate configuration of the remaining lines of the circulating line system 5 in a vertical direction above the container 7, assurance may possibly be provided that they will be emptied automatically after the pump system 17 has been switched off, by the fact that the coating medium therein will run automatically back into the container 7. Based upon the configuration of the exemplary embodiment of the equipment 1 aforedescribed with respect to FIGS. 1 to 4, both the metering system 3 and the circulating line system 5 can be emptied completely if the pumps 19 and 21 operate only sufficiently long enough when the valve configuration 32 is in its aforedescribed functional position "emptying". There is no dependence here upon the flowing of the liquid coating medium back automatically into the container 7, in order to empty the entire circulation-line system 5 and the metering system 3 completely, apart from the flow line 33.

The equipment 1 described heretofore with reference to FIGS. 1 and 3 further includes a container 53 for a liquid cleaning medium, which can be introduced into the circulating line system 5 that is described in greater detail hereinbelow with regard to FIG. 4.

FIG. 4 shows the equipment 1 described with reference to FIGS. 1 and 3, the circulating line system 5 being in a condition wherein the container 7 having the coating medium therein is uncoupled from the circulating line system 5, and the container 53 having the cleaning fluid therein is connected to the circulating line system 5. The lines of the circulating line system 5 which are active during the cleaning operation are represented by a thick line in FIG. 4. In the functional position of the valve configuration 32 illustrated in FIG. 4, there is a medium connection between the suction side of the feed pump 19 and the container 53, which can be produced via the flow line 35, the first valve device 37, the connecting line 51, the fourth valve device 49 and a flow line 55. It is believed to be readily apparent that the medium connections between the circulating line system 5 and the container 7 are shut off by the valve devices 37 and 45. The cleaning fluid outputted by the feed pump 19 passes via the flow line 29 into the feed line 27, and therefrom to the metering system 3. With the aid of the return pump 21, the cleaning fluid in the metering system 3 is extracted and fed back into the container 53 via a medium connection between the return pump 21 and the container 53. This medium connection is formed here by the return line 46A, the third valve device 45 and a return line 57.

In order to remove the cleaning fluid from the circulating line system 5 again, starting from the functional position of the valve configuration 32 described with reference to FIG. 4, the following procedure takes place: initially, the fourth valve device 49 is switched over so that the medium connection between the suction side of the feed pump 19 and the container 53 is interrupted and, via the fourth valve device 49, ambient air (the arrow X) is sucked in or aspirated by the feed pump 19. Assurance is thereby provided that the cleaning fluid in the connecting line 51 and the forward flow lines 35 and 29 is pumped preferably completely into the feed line 27. During this performance, the return pump 21 extracts the cleaning fluid from the metering system 3 via the return line 41 and guides it back into the container 53. After the medium connection between the suction side of the feed pump 19 and the fourth valve device 49 is at least approximately, though preferably completely, fluid-free, the first valve device 31 is switched over so that the medium connection between the feed line 27 and the forward flow line 29 is shut off and, at the same time, the bypass 47 is opened. This ensures that the cleaning fluid remaining in the feed line 27 can be extracted by the return pump 21 via the bypass 47 and fed back into the container 53.

From the foregoing explanations, it is believed to become readily apparent that, through the intermediary of the equipment 1, automatic emptying of at least the metering system 3 and the feed line 27 is readily possible, only two pumps, namely the feed pump 19 and the return pump 21, being required for this purpose. In the equipment 1 described hereinbefore with reference to FIGS. 1 to 4, the pumps 19 and 21 are in operation both during normal operation and during an emptying and cleaning operation and can therefore be driven together readily, as described hereinbefore, by a single motor.

In a preferred embodiment, provision is made for the valve devices 31, 37, 45 and 49 to be formed by a ball valve, in particular a three-way ball valve, respectively. This affords very quick opening and shutting off of the respective medium path. The valve devices 31, 37, 45 and 49, respectively, have an actuating device 59 assigned thereto, which can be actuated by a control unit 61. Also connected to the control unit 61 is a sensor 63, by which the level in the trough 11 of the metering system 3 can be monitored. Based upon the aforedescribed configuration of the equipment 1, automatic emptying of the metering system 3 and at least of the forward feed line 27 of the circulating line system 5 is possible, without requiring an operator to intervene manually for this purpose.

The actuating devices 59 are actuatable electrically, pneumatically or hydraulically.

Figure 5:
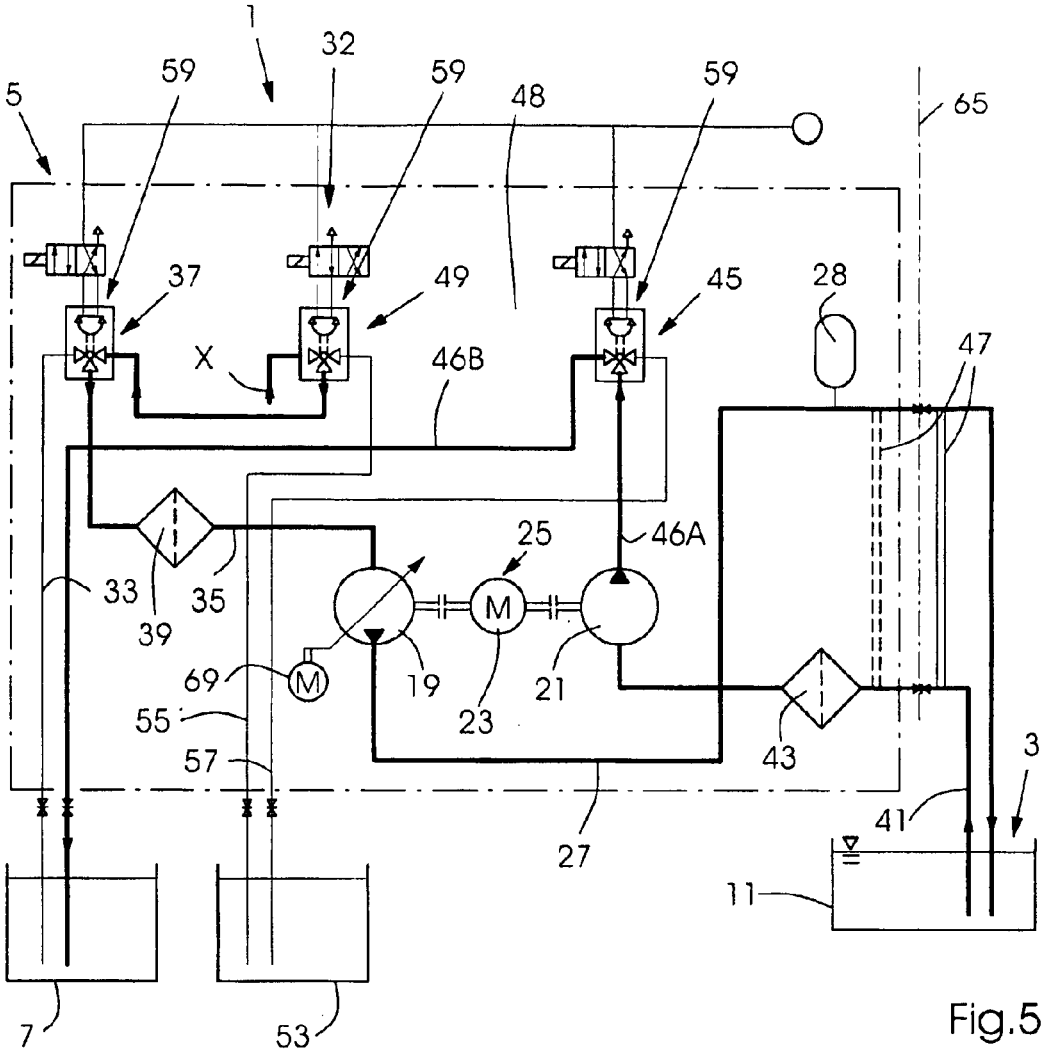
FIG. 5 is a basic schematic and block diagram of a second exemplary embodiment of the equipment according to the invention.

FIG. 5 shows a further exemplary embodiment of the equipment 1. Like parts are identified by the same reference numerals or characters, so that to this extent reference is made to the description relating to FIGS. 1 to 4. Hereinafter, only differences will be discussed in detail. The valve equipment 32 includes only the valve devices 37, 45 and 49. The feed line 27 is connected directly to the pressure side of the feed pump 19. The bypass 47 disposed between the feed line 27 and the return line 41 is formed here by continuous or solid lines and has a defined line cross section. The bypass 47 cannot be shut off, so that during the feeding of the liquid coating medium and the cleaning fluid, respectively, to the metering system 3, a specific quantity of the liquid medium is guided past the metering system 3 and pumped into the corresponding container 7 and 53, respectively. In this exemplary embodiment, the bypass 47 is disposed outside the system boundary of the coating-medium supply device, which is represented by a dash-dot or phantom line 65. Of course, it is also readily possible to place the bypass 47 within the circulating line system 5, which is shown here enclosed by a box formed of dot-dash or phantom lines. It is important that, through the intermediary of the bypass 47, a medium connection between the feed line 27 and the suction side of the return pump 21 exists and can be opened, respectively.

Hereinafter, the function of the equipment 1 illustrated in FIG. 5 will be explained in detail:

Operating Mode "Circulate Coating Medium":

Through the intermediary of the feed pump 19, the coating medium is sucked in or aspirated from the container 7 via the second valve device 37 and delivered to the metering system 3. The pulsation damper 28 minimizes the typical pulses from the feed pump 19, formed here as a diaphragm pump. The return pump 21 extracts the excess liquid coating medium from the metering system 3. In this regard, the coating medium passes through the filter 43. The return pump 21 conducts the liquid coating medium back into the container 7 via the third valve device 45. In this operating mode of the equipment 1, the coating medium is conducted in a circulatory loop or circuit and is subjected to continuous mixing. The metering system 3, of which only the trough 11 is illustrated in FIG. 5, draws the required coating medium from this circuit. During the operating mode "circulating coating medium", the bypass 47 serves for branching off a small quantity of the liquid coating medium upstream of the metering system 3, to prevent the medium from getting into the metering system 3. The coating medium guided past the metering system 3 via the bypass 47 passes directly from the feed line 27 into the return line 41, which is connected to the suction side of the return pump 21.

Operating Mode "Empty Circulating Line System":

In-this operating mode, the feed pump 19 then sucks in ambient air instead of the coating medium via the valve devices 37 and 49. The valve devices 37 and 49 are switched over appropriately for this operating mode. In this regard, the rest of the coating medium is removed from the feed line 27 in the above manner. The return pump 21 extracts the coating medium from the metering system 3 and delivers it back into the container 7. The return pump 21 then assists in the emptying of the feed line 27 via the bypass 47. After the emptying operation, for example, a cleaning operation can be initiated, which is described hereinbelow.

Operating Mode "Clean":

In this operating mode, by appropriately setting the valve devices 49 and 37, the cleaning medium is sucked in from the container 53 by the feed pump 19 and delivered to the metering system 3 through the circulating line system 5. The return pump 21 extracts the cleaning medium from the metering system 3 and delivers it back into the container 53 via the valve device 45. Here, too, a small amount of the cleaning medium is fed back directly into the container 53 by the return pump 21 via the bypass 47, i.e., past the metering system 3.

Operating Mode "Remove Cleaning Medium":

The feed pump 19 then sucks in ambient air again instead of the cleaning medium, in a manner similar to that in the operating mode "empty circulating line system". In this regard, the cleaning medium is forced out of the feed line 27 into the metering system 3. The return pump 21 assists in this emptying operation via the bypass 47.

Figure 6:
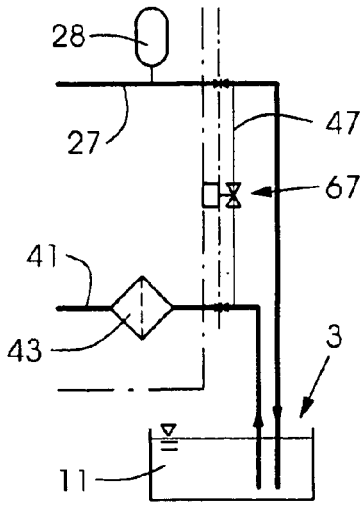
FIG. 6 is a fragmentary view of the diagram of FIG. 5, showing a portion thereof modified so as to form, with the rest of FIG. 5, a third exemplary embodiment of the equipment according to the invention.

FIG. 6 shows a detail of a further exemplary embodiment of the equipment 1, which differs from the exemplary embodiment described with respect to FIG. 5, only in that a restrictor or throttle 67 is disposed in the bypass 47, and can preferably be actuated by the non-illustrated control unit 61. By the preferably automatically controlled restrictor or throttle 67, the amount of the liquid medium flowing through the bypass 47 can be adapted to the viscosity of the coating medium. It has proven to be advantageous to place the restrictor or throttle 67 at the lowest point in the circulating line system 5.

In the exemplary embodiments of the equipment 1 described herein with reference to FIGS. 5 and 6, the actuating drive 59 can be actuated pneumatically specifically via a 5/2-way pneumatic valve, respectively, which in turn can be actuated electromagnetically. Of course, other configurations of the actuating drive 59 for actuating the respectively associated valve device can readily be used. The valve devices 37, 45 and 49, respectively, are formed here by a three-way ball valve, which can be switched over in an appropriate manner by the associated actuating drive 59. The feed pump 19 and the return pump 21 are coupled with one another here and are driven by the common motor 23. The feed pump 19 further has an actuating motor 69 assigned thereto, which serves for regulating the delivery volume of the feed pump 19.

A factor which is common to all the exemplary embodiments of the equipment 1 is that automatic emptying of at least the feed line 27 is readily realizable. Assuming an appropriate configuration of the circulating line system 5, for example, as described herein with reference to FIGS. 1 to 6, complete emptying of the circulating line system 5 and of the metering system 3 is realizable.

We claim:

1. A method of operating equipment for coating printing materials in a printing press, the method which comprises:

providing equipment including at least one metering system and a circulating line system associated with the metering system for at least one liquid medium received in at least one container, the circulating line system having a pump subsystem including at least one feed pump for feeding the liquid medium from the container to the metering system, and at least one return pump for returning the liquid medium from the metering system into the container, and a feed line disposed between the metering system and the feed pump; and at least partially emptying at least the feed line by carrying out the steps of:

shutting off a medium connection between the feed pump and the container; and connecting a suction side of the feed pump to a space having a gaseous medium, for sucking in the gaseous medium by the feed pump and, as viewed in pumping direction of the feed pump, for pumping the gaseous medium into the feed line; and during the step of at least partially emptying at least the feed line, sucking in ambient air as the gaseous medium by the return pump via a bypass disposed between the feed line and a suction side of the return pump and via the feed line.

2. The method according to claim 1, which further comprises completely emptying at least the feed line.

3. The method according to claim 1, which further comprises, during the step of at least partially emptying at least the feed line, sucking in the liquid medium by the return pump in the bypass disposed between the feed line and the suction side of the return pump and in the feed line, and conducting the liquid medium back into the container.

4. The method according to claim 1, which further comprises pumping the gaseous medium being sucked in by the feed pump, directly into the feed line.

5. The method according to claim 1, which further comprises pumping the gaseous medium being sucked in by the feed pump, into the feed line via a medium connection disposed between a pressure side of the feed pump and the feed line.

6. The method according to claim 1, which further comprises, during the step of at least partially emptying at least the feed line, emptying the metering system via a medium connection disposed between the metering system and a suction side of the return pump during operation of the return pump.

7. The method according to claim 1, which further comprises, during the step of at least partially emptying at least the feed line, operating both the feed pump and the return pump.

8. The method according to claim 1, which further comprises setting a delivery direction of at least one of the feed pump and the return pump to be the same both during feeding of one of a liquid coating medium and a cleaning fluid to the metering system, and during the emptying of the feed line.

9. The method according to claim 1, which further comprises, at a start of emptying of the feed line, shutting off the bypass completely, and initially feeding the gaseous medium sucked in by the feed pump to the feed line, while simultaneously emptying the metering system by the return pump.

10. The method according to claim 9, which further comprises subsequently shutting off the medium connection between a pressure side of the feed pump and the feed line, and opening the bypass for pumping the liquid medium remaining in the feed line into the container by the return pump.

11. The method according to claim 10, which further comprises continuing the operation of the feed pump even upon the medium connection between the pressure side thereof and the feed line being blocked.

12. The method according to claim 1, which further comprises maintaining the bypass always at least partly open during feeding of one of a liquid coating medium and a cleaning fluid to the metering system and emptying the feed line.

13. The method according to claim 12, which further comprises adjusting a quantity of medium returned past the metering system via the bypass and into the container.

14. Equipment for coating printing materials in a printing press, comprising:

at least one container;

at least one metering system;

a circulating line system associated with said metering system for at least one liquid medium received in said at least one container;

said circulating line system including a pump subsystem having at least one feed pump for feeding the liquid medium from said container to said at least one metering system, and at least one return pump for returning the liquid medium from said at least one metering system into said container, said at least one seed pump having a suction side;

a feed line disposed between said at least one metering system and said at least one feed pump;

a medium connection between said suction side of said at least one feed pump and said container;

a medium connection to be at least partly shut off, said medium connection disposed between said feed pump and said feed line;

valve device for at least partly shutting off said medium connection disposed between said feed pump and said feed line; and a valve configuration including said value device for influencing flow of the liquid medium in said circulating line system, said valve configuration having a functional position shutting off said medium connection and connecting said suction side of said at least one feed pump to a space having at least one gaseous medium therein.

15. The equipment according to claim 14, wherein said return pump has a suction side, a bypass is disposed between said feed line and said suction side of said return pump, and a valve device at least partly shuts off and opens said bypass.

16. The equipment according to claim 15, wherein said valve configuration has another functional position having said bypass and said medium connection between said suction side of said feed pump and said container shut off, and said suction side of said feed pump connected to the space receiving the gaseous medium therein.

17. The equipment according to claim 15, wherein said valve configuration has a third functional position having said medium connection between said suction side of said feed pump and said container and a medium connection between said feed pump and said feed line shut off, said suction side of said feed pump connected to said space having said gaseous medium therein, and said bypass opened.

18. The equipment according to claim 15, wherein said valve configuration has an additional functional position having said medium connection between said suction side of said feed pump and said container opened, and said bypass and a connection between said suction aide of said feed pump and said space having said gaseous medium therein shut off.

19. The equipment according to claim 14, wherein said valve configuration has a plurality of valve devices, and at least one of said valve devices is a ball valve.

20. The equipment according to claim 19, wherein said ball valve is a three-way ball valve.

21. The equipment according to claim 14, wherein said feed pump and said return pump are to be actuated simultaneously.

22. The equipment according to claim 14, wherein at least one of said feed and return pumps is for pumping both liquid and gaseous media.

23. The equipment according to claim 14, further comprising only one drive device for actuating said feed pump and said return pump.

24. The equipment according to claim 23, wherein said only one drive device has only one motor.

25. The equipment according to claim 14, wherein at least one of said feed and return pumps is a pump selected from the group consisting of a displacement pump and a peristaltic pump.

26. The equipment according to claim 14, wherein said pump subsystem is a double diaphragm pump.

27. The equipment according to claim 14, wherein said valve configuration has a plurality of valve devices, and a control unit actuates at least one of said valve devices, said feed pump and said return pump.

28. The method according to claim 1, which further comprises providing ambient air as the gaseous medium.

29. The equipment according to claim 14, wherein said gaseous medium is ambient air.

* * * * *